US005199495A

United States Patent [19]

Brammer et al.

[11] Patent Number: 5,199,495

[45] Date of Patent: Apr. 6, 1993

[54] SPLIT WEAR BUSHING FOR A DRILLING RIG

[75] Inventors: Norman Brammer, Fyvie Turiff, Scotland; Herman O. Henderson, Jr.; Richard W. Slyker, both of Houston, Tex.

[73] Assignee: ABB Vetco Gray Inc., Houston, Tex.

[21] Appl. No.: 815,712

[22] Filed: Dec. 30, 1991

[51] Int. Cl.[5] ..... E21B 7/12; E21B 17/10

[52] U.S. Cl. ..... 166/339; 166/85; 166/340; 166/379; 175/5; 175/7

[58] Field of Search ..... 175/7, 5; 166/339, 340, 166/379, 85, 378, 348

[56] References Cited

U.S. PATENT DOCUMENTS

| | | | |
|---|---|---|---|
| 3,163,220 | 12/1964 | Haeber et al. | 175/7 X |
| 3,227,229 | 1/1966 | Wakefield | 175/7 |
| 3,247,914 | 4/1966 | Slack | 175/7 |
| 3,301,324 | 1/1967 | Smith | 175/7 X |
| 3,489,214 | 6/1968 | Phipps et al. | 166/85 |
| 3,645,328 | 2/1972 | Greene, Jr. | 166/85 |
| 4,326,584 | 4/1982 | Watkins | 166/82 |
| 4,362,210 | 12/1982 | Green | 166/85 |
| 4,674,576 | 6/1987 | Goris et al. | 166/382 |
| 4,691,780 | 9/1987 | Galle, Jr. et al. | 166/348 |
| 4,978,147 | 12/1990 | Henderson, Jr. et al. | 285/2 |
| 5,025,864 | 6/1991 | Nobilean | 166/348 |

*Primary Examiner*—Hoang C. Dang
*Attorney, Agent, or Firm*—James E. Bradley

[57] ABSTRACT

A split wear bushing for a subsea well assembly provides a standoff for the drill pipe to avoid damage to the casing near where it secures to the casing hanger. The split wear bushing has an outer wear bushing that locks into the casing hanger. An inner wear bushing lands in the bore of the outer wear bushing. The inner wear bushing has an inner diameter that is smaller than the inner diameter of the casing to provide a standoff. The inner wear bushing is carried on a wear bushing sub. An engaging shoulder on the wear bushing sub contacts the inner wear bushing during each trip of the drill string to pull the inner wear bushing from the outer wear bushing. The inner wear bushing relocks to the outer wear bushing on the return trip. A retrieval lock enables the outer wear bushing to be retrieved along with the inner wear bushing for the final trip.

28 Claims, 4 Drawing Sheets

SPLIT WEAR BUSHING FOR A DRILLING RIG

BACKGROUND OF THE INVENTION

1. Field of the invention

This invention relates in general to subsea well drilling, and in particular to a split wear bushing that holds the drill pipe away from the casing near the casing hanger to avoid key seating.

2. Description of the Prior Art

In subsea well drilling of the type concerned herein, a wellhead housing will be located at the sea floor. After the well has been drilled to a selected depth, casing will be lowered into the well and cemented into place. A casing hanger lands at the wellhead housing, the casing hanger being secured by threads to the upper end of the casing. Then, the operator will lower a drill bit from the drilling vessel down through the wellhead housing into the well for further drilling.

Damage can occur to the casing hanger bore and casing by the contact of rotating drill pipe while drilling. This can particularly be a problem when the drill pipe has hardened or otherwise enhanced wear resistant tool joints. It is possible for the drill pipe to wear a hole into the casing from the rubbing contact during drilling.

Wear bushings are normally employed to prevent damage to the casing hanger. A typical wear bushing is a tubular member that lowers into and seats in the casing hanger. A typical prior art wear bushing has a bore that is the same as the bore of the lower section of the casing hanger and the same as the inner diameter of the casing. Although prior art wear bushings will protect the casing hanger from damage, they do not have a means to prevent damage to the casing near the point where the casing secures to the casing hanger.

SUMMARY OF THE INVENTION

In this invention, a split wear bushing is employed. An outer wear bushing lands and is supported on the casing hanger. An inner wear bushing locates in the bore of the outer wear bushing. The bore of the inner wear bushing is smaller than the inner diameter of the casing. The smaller bore provides a standoff to prevent the drill pipe from contacting the casing near the point where it connects to the casing hanger.

The inner wear bushing is lowered into the wellhead by means of a wear bushing sub connected into the drill string. When the drill pipe is being retrieved for a round trip, such as to replace the bit, the wear bushing sub will contact the inner wear bushing and retrieve it to the surface along with the drill pipe. The outer wear bushing will remain attached to the casing hanger. The inner wear bushing is lowered again with the wear bushing sub and locks into the outer wear bushing once the assembly reaches the wellhead housing.

In the preferred embodiment, the inner wear bushing locks to the outer wear bushing by means of an elastomeric shear ring. When retrieving the inner wear bushing for a round trip, this shear ring will shear, leaving the outer wear bushing secured to the casing hanger. The operator places a replacement shear ring on the inner wear bushing when returning the inner wear bushing for further drilling. The replacement inner shear ring locates in a groove provided in the outer wear bushing.

In the preferred embodiment, the outer wear bushing may be retrieved to the surface along with the inner wear bushing if the operator has completed drilling.

The outer wear bushing releasably locks to the casing hanger also by means of an elastomeric shear ring. This outer shear ring has a greater shear strength than the shear ring located between the inner and outer wear bushings. Consequently, on round trips, the outer shear ring will not shear, and only the shear ring between the inner and outer wear bushings shears and is replaced each round trip.

For a final trip, the operator increases the shear strength between the inner and outer wear bushings. This may be handled by utilizing an additional retrieval shear ring between the inner and outer wear bushings only when the operator wishes to retrieve the outer wear bushing. The combined shear strength of the retrieval shear ring and the other shear ring located between the inner and outer wear bushings exceeds that of the outer shear ring. When retrieving the drill pipe on the final trip out, the wear bushing sub will contact the inner wear bushing. The outer shear ring will shear from the casing hanger, allowing the entire wear bushing assembly to be pulled from the wellhead housing.

DETAILED DESCRIPTION OF THE INVENTION

Figure 1A:
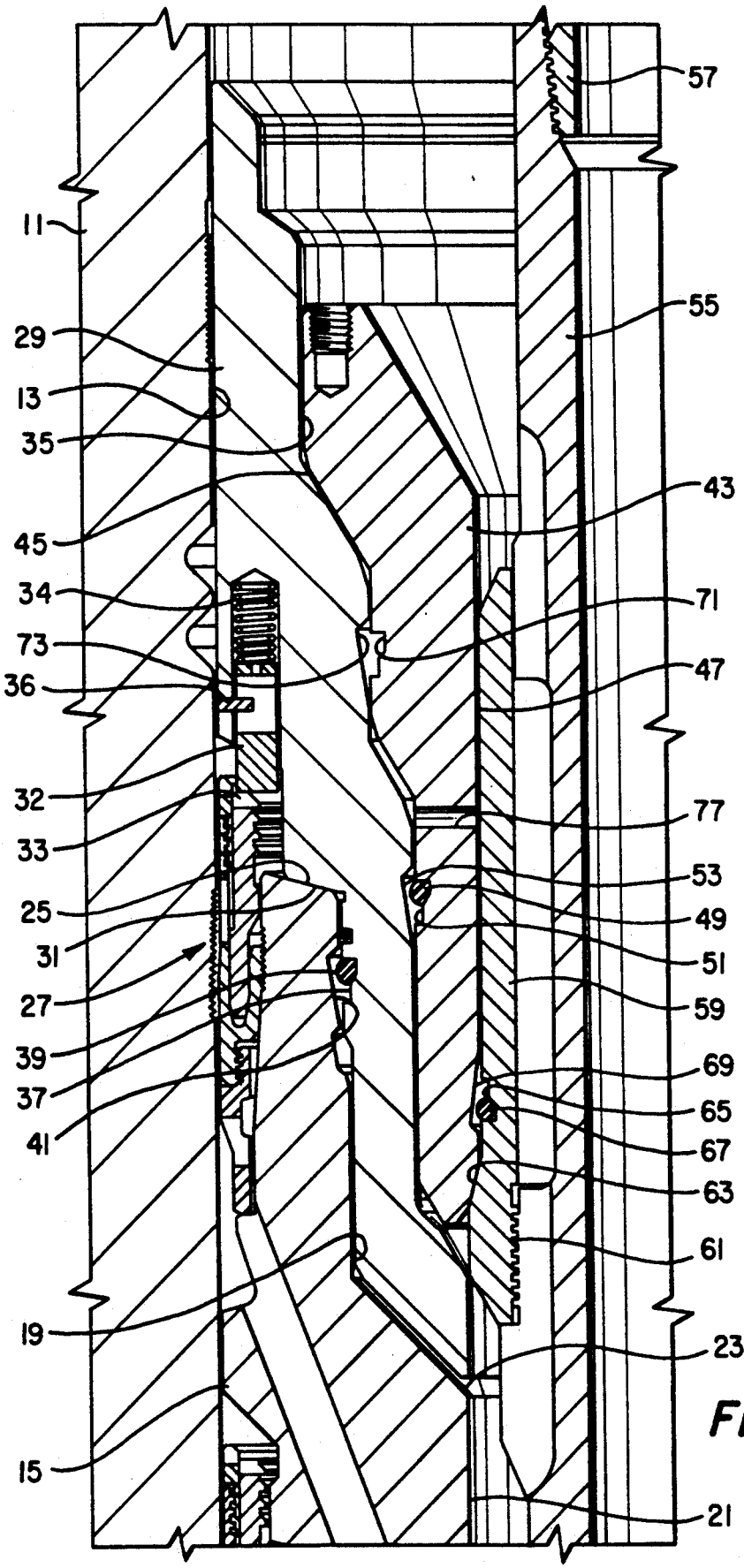
FIGS. 1A and 1B are quarter sectional views illustrating a wear bushing assembly constructed in accordance with this invention.
Figure 1B:
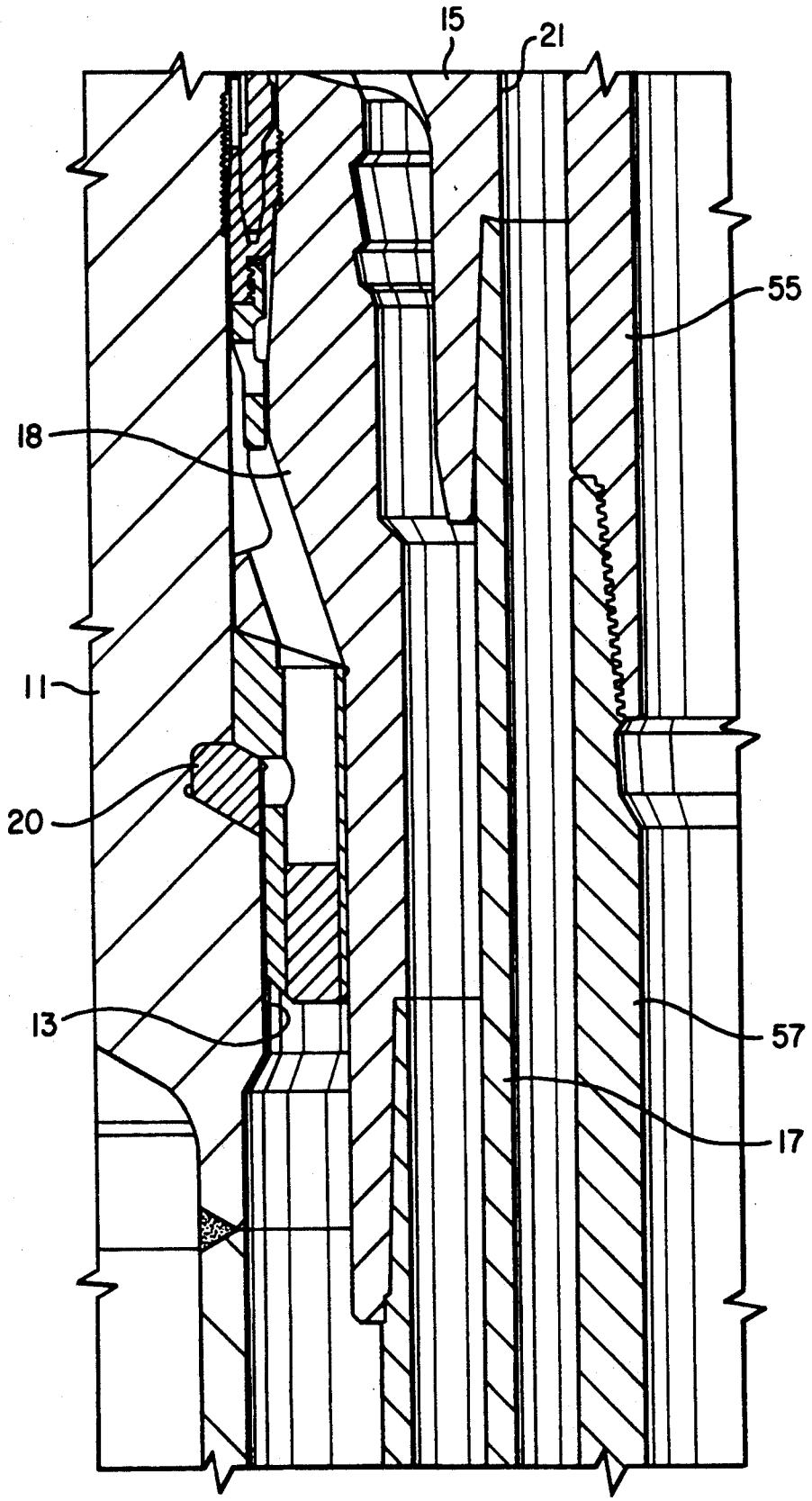

Referring to FIG. 1A, wellhead housing 11 is a conventional member located at the sea floor. Wellhead housing has a generally cylindrical bore 13. A casing hanger 15 will land in wellhead housing 11 on a landing shoulder. In the embodiment shown, the landing shoulder comprises an upper end of a previously landed casing hanger 18 (FIG. 1B). This invention works in the same manner in connection with the first landed casing hanger 18, which lands on a landing shoulder 20.

Casing hanger 15 secures on its lower end to a string of casing 17 (FIG. 1B). Casing hanger 15 has an upper bore section 19 and a lower bore section 21 separated by an upward facing conical shoulder 23. The lower bore section 21 has the same inner diameter as the inner diameter of casing 17. The upper bore section 19 has a larger diameter than the lower bore section 21. Casing hanger 15 has a rim 25 on its upper end. A seal assembly 27 of conventional design seals the annular space surrounding casing hanger 15 and bore 13 of wellhead housing 11.

An outer wear bushing 29 lands in casing hanger 15. Outer wear bushing 29 has a downward facing shoulder 31 that lands on casing hanger rim 25. Outer wear bushing 29 has a lower portion that extends into and covers casing hanger bore section 19 and shoulder 23. A conventional means exists for preventing outer wear bushing 29 from rotating relative to the casing hanger 15. This means includes a longitudinally extending pin 32 which engages a slot 33 located in the upper end of seal assembly 27. A spring 34 urges the pin 32 downward. A radially extending pin 36 engages a slot in pin 32 to retain pin 32.

Outer wear bushing 29 has a bore 35 that is of several different diameters, separated by conical shoulders. The lowermost portion of bore 35 is the same inner diameter as the inner diameter of the casing hanger lower bore section 21. The remaining portions of bore 35 are larger in diameter.

Figure 4:
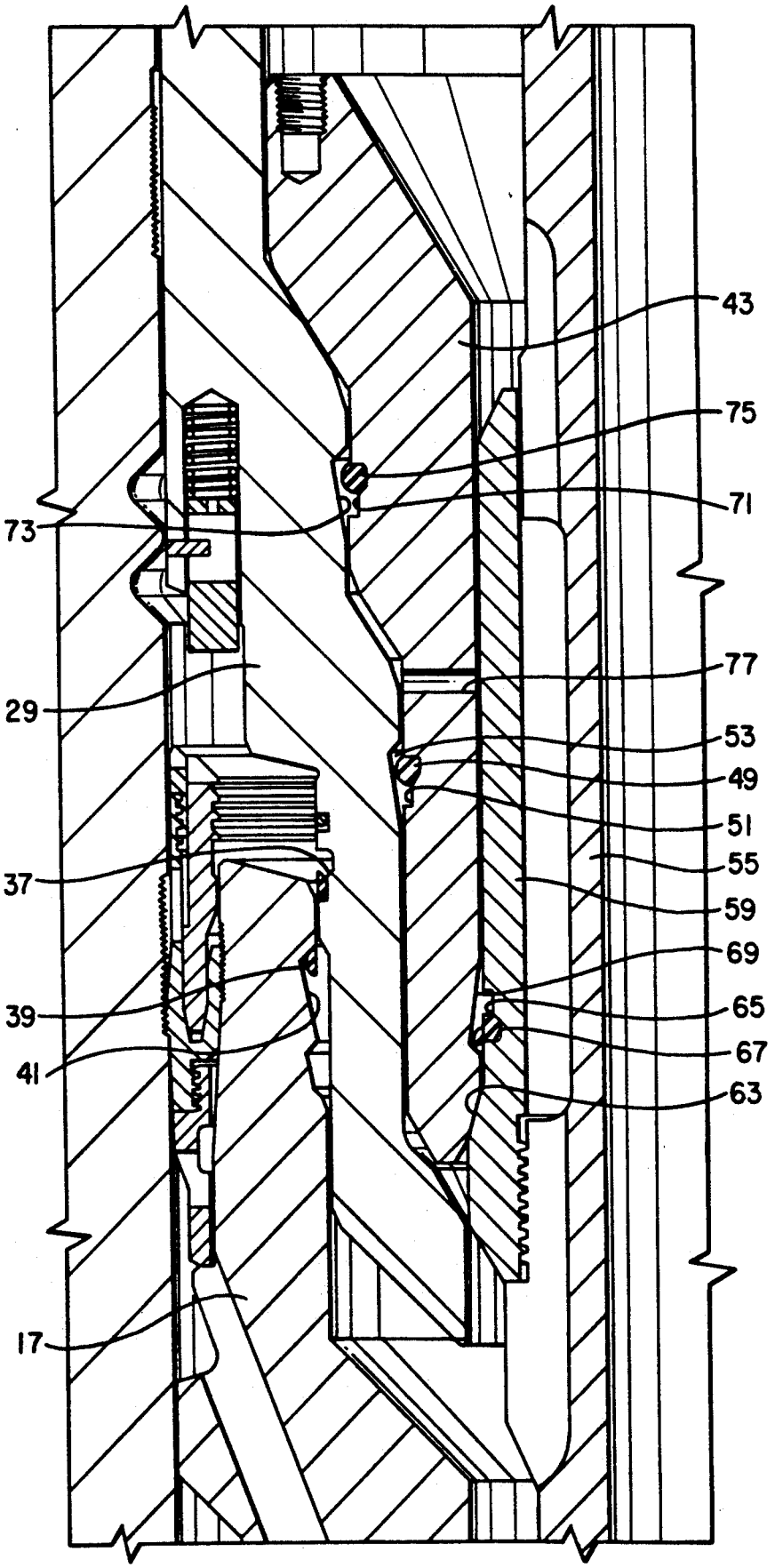
FIG. 4 is another partial sectional view of the well bushing assembly of FIG. 1, showing the inner and outer wear bushings being retrieved from the casing hanger.

A locking means will releasably secure outer wear bushing 29 to casing hanger 15. The locking means comprises an outer recess 37 formed on the exterior of outer wear bushing 29. An elastomeric shear ring 39 locates in outer recess 37. Shear ring 39 is preferably a "D" shaped ring. Outer recess 37 has two different diameter portions, with the larger diameter portion being located below the smaller diameter portion. Outer recess 37 mates with a casing hanger recess 41 formed in the casing hanger upper bore section 19. The two different diameters of the outer recess 37 enable the outer wear bushing 29 to be pressed inward into casing hanger 15 with much less force than required to shear shear ring 39 when pulling outer wear bushing 29 upward from casing hanger 15. FIG. 4 shows outer shear ring 39 sheared. U.S. Pat. No. 4,978,147, issued Dec. 18, 1990, Herman O. Henderson, Jr., et al, describes in more detail elastomeric shear rings of this type utilized in connection with wear bushings and is hereby incorporated by reference.

An inner wear bushing 43 lands in bore 35 of outer wear bushing 29. Inner wear bushing 43 has a bore 47 that is generally cylindrical. The inner diameter of bore 47 is significantly smaller than the inner diameter of casing hanger lower bore section 21 and of the casing 17.

Figure 3:
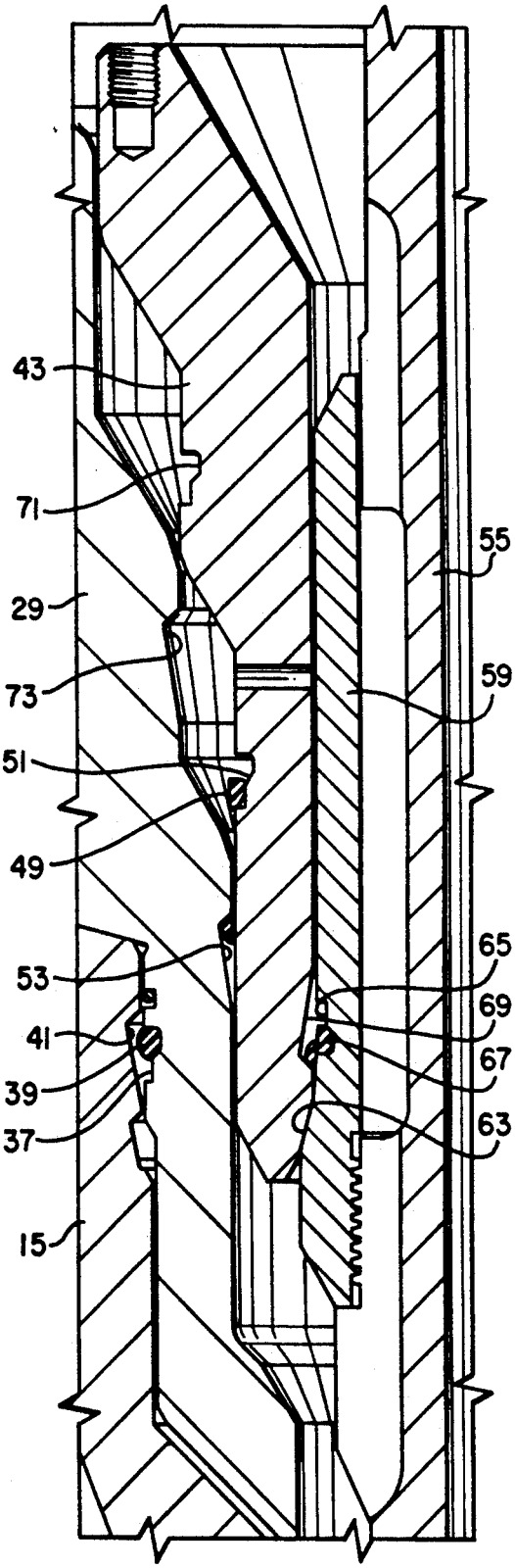
FIG. 3 is another sectional view of a portion of the wear bushing assembly of FIG. 1, showing the inner wear bushing being retrieved from the outer wear bushing.

A locking means will releasably lock inner wear bushing 43 to outer wear bushing 29. The locking means includes an intermediate shear ring 49 that is carried in mating intermediate recesses 51 and 53. Recesses 51 and 53 and intermediate shear ring 49 operate in the same manner as outer shear ring 39. The inner wear bushing 43 can be pressed into outer wear bushing 29, with the intermediate shear ring 49 locating in the intermediate recess 53. An upward pull with sufficient force will cause the shear ring 49 to shear, this force being significantly greater than the insertion force. The shear force required to shear intermediate shear ring 49 is significantly less than the shear force required to shear outer shear ring 39. Upward force on inner wear bushing 43 will shear intermediate shear ring 49 as shown in FIG. 3, allowing inner wear bushing 43 to be retrieved to the surface while outer wear bushing 29 remains locked to casing hanger 15.

A wear bushing sub 55 initially carries the inner wear bushing 43 and the outer wear bushing 29 into the wellhead housing 11. Wear bushing sub 55 is a tubular member which connects on its upper and lower ends into a string of drill pipe 57. Wear bushing sub 55 has a tubular engaging member 59 secured by threads 61. Engaging member 59 fits closely in the bore 47 of inner wear bushing 43. An upward facing exterior engaging shoulder 63 on the lower end of engaging member 59 will contact the lower end of inner wear bushing 43. Engaging shoulder 63 will transmit an upward force to inner wear bushing 43 when drill pipe 57 is pulled upward.

A locking means will releasably lock the inner wear bushing 43 to the wear bushing sub 55. This locking means includes an inner recess 65 that receives an inner shear ring 67. Shear ring 67 mates with an inner recess 69 formed in bore 47. Inner shear ring 67 is also an elastomeric "D" shaped ring and operates in the same manner as described in connection with outer shear ring 39 and intermediate shear ring 49. However, recesses 65, 69 are oriented inverse to the recesses 51, 53 and 37, 41. A downward force will cause inner shear ring 67 to shear, rather than an upward force. The portion of inner recess 65 of greater diameter is located on the upper section of the recess 65, rather than on the lower section as in recesses 51 and 37.

A pair of mating retrieval recesses 71, 73 are utilized only when the operator wishes to retrieve the outer wear bushing 29. Retrieval recesses 71, 73 are located on the exterior of inner wear bushing 43 and bore 35 of outer wear bushing 29, respectively. A retrieval shear ring 75, shown only in FIG. 4, is installed only on the final trip before the outer wear bushing 29 is to be retrieved. Retrieval shear ring 75 does not shear. The combined shear strength of retrieval shear ring 75 and intermediate shear ring 49 is greater than the shear strength of outer shear ring 39. When both the retrieval shear ring 75 and the intermediate shear ring 49 are installed, an upward force by engaging shoulder 63 will cause the outer shear ring 39 to shear as shown in FIG. 4. A passage 77 extends through the wall of inner wear bushing 43 between recess 51 and recess 71. Passage 77 prevents hydraulic lock when the inner wear bushing 43 is inserted into outer wear bushing 29 when retrieval shear ring 75 is installed.

In operation, the operator will install wellhead housing 11, casing 17 and casing hanger 15 in a conventional manner. The operator then secures a bit (not shown) to the end of drill string 57. The operator secures inner wear bushing 43 to outer wear bushing 29 by pressing inner wear bushing 43 into outer wear bushing 29 until intermediate shear ring 49 locates in recess 53. The operator slides the inner wear bushing 43 over the wear bushing sub 55. Pressing downward will cause the inner shear ring 67 to locate in recesses 65, 69. The operator then secures the upper end of wear bushing sub 55 to drill pipe 57 and lowers the entire assembly into the well.

Figure 2:
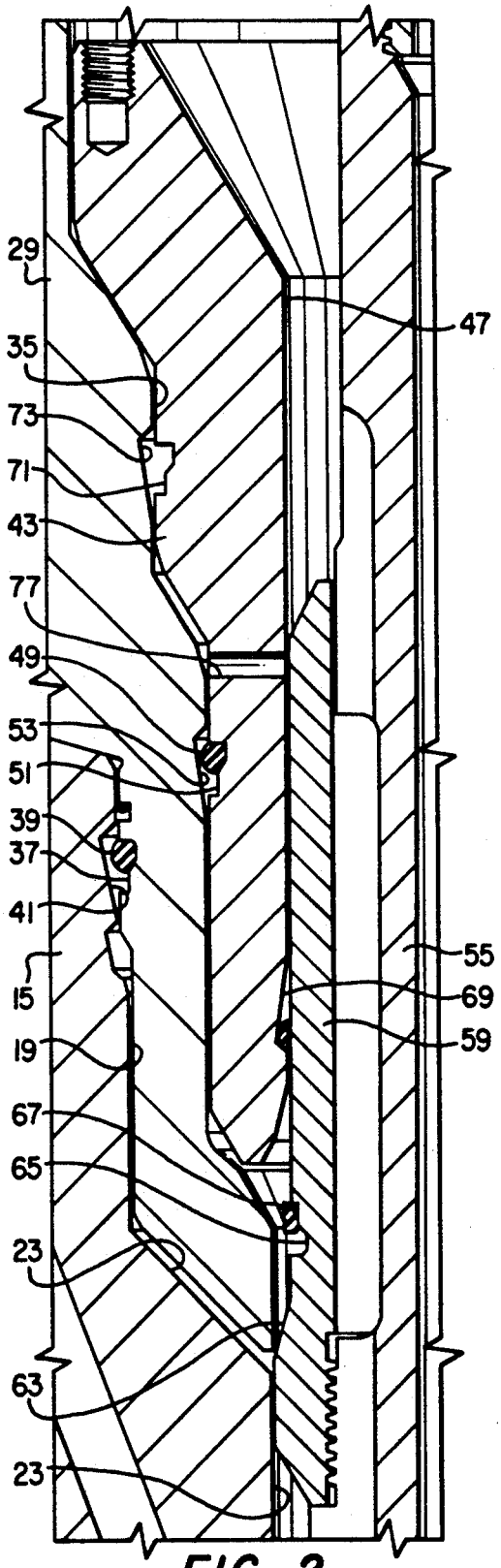
FIG. 2 is a view of a portion of the wear bushing of FIG. 1, showing the wear bushing sub and drill pipe being lowered relative to the inner and outer wear bushings.

The outer wear bushing shoulder 31 will contact rim 25 of casing hanger 15. The weight of the drill string 57 will cause the outer shear ring 39 to deform until locating in the casing hanger recess 41. Continued downward force due to the weight of the drill string 57 will cause the inner shear ring 67 to shear as shown in FIG. 2. A portion of the shear ring 67 will remain in recess 69 while a portion remains in recess 65. The operator lowers the drill bit (not shown) to the bottom of the well and begins drilling by rotating the drill string 57. The drill string 57 rotates within inner wear bushing 43, which protects the bore sections 19, 21 from damage. The smaller bore 47 than the inner diameter of casing 17 provides a standoff of drill string 57. The standoff prevents drill string 57 from contacting the casing hanger lower bore section 21 and the casing 17 near the upper end.

When the operator wishes to make a round trip, which normally occurs when the drill bit has become dull, the operator will begin pulling the drill string 57 from the well. Eventually the engaging shoulder 63 will contact the inner wear bushing 43. The upward force will cause the intermediate shear ring 49 to shear as shown in FIG. 3. Intermediate shear ring 49 shears, rather than the outer shear ring 39, because of the greater shear strength of the outer shear ring 39. In the drawings, a portion of intermediate shear ring 49 remains in recess 53. However, a catcher groove (not shown) could be formed on the inner wear bushing 43 below recess 51 to retrieve the other portion of intermediate shear ring 49. Such a catcher groove is shown in U.S. Pat. No. 4,978,147, Herman O. Henderson, Jr., issued Dec. 18, 1990.

The operator retrieves the inner wear bushing 43 to the surface along with the wear bushing sub 55. The outer wear bushing 29 remains secured to casing hanger 15. The operator replaces the bit and places a new intermediate shear ring 49 on the inner wear bushing 43. The operator places a new inner shear ring 67 in the recess 65 and inserts the inner wear bushing 43 over the wear bushing sub 55 until the recesses 65, 69 align. The operator lowers the inner wear bushing 43 back into the well. The new intermediate shear ring 49 will be forced into engagement with the recess 53 upon the application of downward force. The inner shear ring 67 will shear again and the drilling operation will be continued.

When it is desired to retrieve the outer wear bushing 29, normally when drilling of that phase of the well has been completed, the operator will on the final trip back into the well add retrieval shear ring 75. The operator will place retrieval shear ring 75 in retrieval recess 71 and a replacement intermediate shear ring 49 in recess 51. As the inner wear bushing 43 is lowered back into the outer wear bushing 29, both the intermediate shear ring 49 and the retrieval shear ring 67 will engage the outer wear bushing 29. The retrieval shear ring 75 will locate in the recesses 71, 73 as illustrated in FIG. 4. The replacement inner shear ring 67 will shear as the drill string 57 is lowered relative to the inner wear bushing 43.

Then, when the final drilling has been completed, and when the engaging shoulder 63 contacts the inner wear bushing 43 while pulling the drill string 57, the outer shear ring 39 will shear. Retrieval shear ring 75 and intermediate shear ring 49 do not shear. The combined strengths of the retrieval shear ring 75 and the intermediate shear ring 49, being in excess of that of the outer shear ring 39, result in the outer wear bushing 29 moving upward with the inner wear bushing 43. The operator will then pull the entire assembly to the surface as illustrated in FIG. 4.

The invention has significant advantages. The split wear bushing positions the drill pipe away from the inner diameter of the casing near the casing hanger. This avoids excessive wear in this portion of the casing.

While the invention has been shown in only one of its forms, it should be apparent to those skilled in the art that it is not so limited, but is susceptible to various changes without departing from the scope of the invention.

We claim:

1. In a subsea well assembly of the type having a wellhead housing, a casing hanger landed in the wellhead housing and supporting a string of casing extending into the well, an improved wear bushing assembly for reducing wear damage occurring when a string of drill pipe is rotated in the well, comprising in combination:

an outer wear bushing removably supported on the casing hanger;

an inner wear bushing removably supported on the outer wear bushing, the inner wear bushing having a bore and being selectively removable from the outer wear bushing by upward movement;

a wear bushing sub connected into the string of drill pipe for extension through the bore of the inner wear bushing, the wear bushing sub being movable downward relative to the inner and outer wear bushings in unison with the drill pipe for further drilling;

the inner diameter of the bore of the inner wear bushing being smaller than an inner diameter of the casing, providing a standoff to reduce contact of the drill pipe with the casing near the casing hanger to reduce wear on the casing; and engaging means on the wear bushing sub for engaging the inner wear bushing to pull the inner wear bushing upward from the wellhead housing with the wear bushing sub and drill pipe when the drill pipe is being removed from the well.

2. The subsea well assembly according to claim 1 further comprising intermediate locking means on the inner wear bushing for releasably locking the inner wear bushing to the outer wear bushing for preventing axial movement of the inner wear bushing relative to the outer wear bushing during drilling, and for selectively releasing the inner wear bushing from the outer wear bushing when the engaging means contacts the inner wear bushing during upward movement of the drill pipe.

3. The subsea well assembly according to claim 1 further comprising:

outer locking means on the outer wear bushing for releasably locking the outer wear bushing to the casing hanger for preventing axial movement of the outer wear bushing relative to the casing hanger during drilling; and intermediate locking means on the inner wear bushing for releasably locking the inner wear bushing to the outer wear bushing for preventing axial movement of the inner wear bushing relative to the outer wear bushing during drilling, and for selectively releasing the inner wear bushing from the outer wear bushing when the engaging means contacts the inner wear bushing during upward movement of the drill pipe.

4. The subsea well assembly according to claim 1 further comprising:

inner locking means on the wear bushing sub for releasably locking the inner wear bushing to the wear bushing sub for allowing the drill pipe to lower the inner wear bushing into the wellhead housing as the drill pipe is being lowered into the well for further drilling, and for releasing the inner wear bushing from the wear bushing sub to allow the wear bushing sub to move downward with the drill pipe once the inner wear bushing has landed in the wellhead housing.

5. The subsea well assembly according to claim 1 further comprising:

outer locking means on the outer wear bushing for releasably locking the outer wear bushing to the casing hanger for preventing axial movement of the outer wear bushing relative to the casing hanger during drilling;

intermediate locking means on the inner wear bushing for releasably locking the inner wear bushing to the outer wear bushing for preventing axial movement of the inner wear bushing relative to the outer wear bushing during drilling, and for selectively releasing the inner wear bushing from the outer wear bushing when the engaging means contacts the inner wear bushing during upward movement of the drill pipe; and inner locking means on the wear bushing sub for releasably locking the inner wear bushing to the wear bushing sub for allowing the drill pipe to lower the inner wear bushing into the wellhead housing as the drill pipe is being lowered into the well for further drilling, and for releasing the inner wear bushing from the wear bushing sub to allow the wear bushing sub to move downward with the drill pipe once the inner wear bushing has landed in the wellhead housing.

6. The subsea well assembly according to claim 1 further comprising:

outer locking means on the outer wear bushing for releasably locking the outer wear bushing to the casing hanger for preventing axial movement of the outer wear bushing relative to the casing hanger during drilling;

intermediate locking means on the inner wear bushing for releasably locking the inner wear bushing to the outer wear bushing for preventing axial movement of the inner wear bushing relative to the outer wear bushing during drilling, and for selectively releasing the inner wear bushing from the outer wear bushing when the engaging means contacts the inner wear bushing during upward movement of the drill pipe;

inner locking means on the wear bushing sub for releasably locking the inner wear bushing to the wear bushing sub for allowing the drill pipe to lower the inner wear bushing and outer wear bushing simultaneously into the casing hanger as the drill pipe is being lowered into the well for further drilling, and for releasing the inner wear bushing from the wear bushing sub to allow the wear bushing sub to move downward with the drill pipe once the inner wear bushing has landed in the wellhead housing; and retrieval locking means selectively actuable when it is desired to retrieve the outer wear bushing, for preventing the intermediate locking means from releasing the inner wear bushing from the outer wear bushing when the engaging means contacts the inner wear bushing during upward movement of the drill pipe, causing both the inner and outer wear bushings to be simultaneously retrieved.

7. The subsea well assembly according to claim 1 further comprising:

inner locking means on the wear bushing sub for releasably locking the inner wear bushing to the wear bushing sub for allowing the drill pipe to lower the inner wear bushing into the wellhead housing as the drill pipe is being lowered into the well for further drilling, and for releasing the inner wear bushing from the wear bushing sub to allow the wear bushing sub to move downward with the drill pipe once the inner wear bushing has landed in the wellhead housing; and intermediate locking means on the inner wear bushing for releasably locking the inner wear bushing to the outer wear bushing for preventing axial movement of the inner wear bushing relative to the outer wear bushing during drilling, and for selectively releasing the inner wear bushing from the outer wear bushing when the engaging means contacts the inner wear bushing during upward movement of the drill pipe.

8. The subsea well assembly according to claim 1 wherein the engaging means comprises an upward facing shoulder located on the exterior of the wear bushing sub, the upward facing shoulder having a diameter that is greater than the bore of the inner wear bushing.

9. In a subsea well assembly of the type having a wellhead housing, a casing hanger landed in the wellhead housing and supporting a string of casing extending into the well, an improved wear bushing assembly for reducing wear damage occurring when a string of drill pipe is rotated in the well, comprising in combination:

an outer wear bushing removably supported on the casing hanger;

an inner wear bushing removably supported on the outer wear bushing, the inner wear bushing having a bore;

a wear bushing sub connected into the string of drill pipe for extension through the bore of the inner wear bushing, the wear bushing sub being movable downward relative to the inner and outer wear bushings in unison with the drill pipe for further drilling;

the inner diameter of the bore of the inner wear bushing being smaller than an inner diameter of the casing near the casing hanger, providing a standoff to reduce contact of the drill pipe with the casing near the casing hanger to reduce wear on the casing;

inner locking means on the wear bushing sub for releasably locking the inner wear bushing to the wear bushing sub for allowing the drill pipe to lower the inner wear bushing into the wellhead housing as the drill pipe is being lowered into the well for further drilling, and for releasing the inner wear bushing from the wear bushing sub to allow the wear bushing sub to move downward with the drill pipe once the inner wear bushing has landed in the wellhead housing;

an engaging shoulder on the wear bushing sub configured to contact the inner wear bushing and lift the inner wear bushing when the wear bushing sub is pulled back upward; and intermediate locking means on the inner wear bushing for releasably locking the inner wear bushing to the outer wear bushing for preventing axial movement of the inner wear bushing relative to the outer wear bushing during drilling, and for selectively releasing the inner wear bushing from the outer wear bushing when the engaging shoulder contacts the inner wear bushing during a during upward movement of the drill pipe.

10. The subsea wellhead assembly according to claim 9 wherein the intermediate locking means relocks the inner wear bushing to the outer wear bushing when the inner wear bushing is returned back into the wellhead housing.

11. The subsea wellhead assembly according to claim 9 wherein the engaging shoulder has an outer diameter that is greater than the inner diameter of the bore of the inner wear bushing.

12. The subsea wellhead assembly according to claim 9 further comprising:

outer locking means on the outer wear bushing for releasably locking the outer wear bushing to the casing hanger for preventing axial movement of the outer wear bushing relative to the casing hanger during drilling; and retrieval locking means selectively actuable when it is desired to retrieve the outer wear bushing, for preventing the intermediate locking means from releasing the inner wear bushing from the outer wear bushing when the engaging shoulder contacts the inner wear bushing during upward movement of the drill pipe, causing both the inner and outer wear bushings to be simultaneously retrieved.

13. The subsea wellhead assembly according to claim 9 wherein the intermediate locking means supports the outer wear bushing to the inner wear bushing so as to allow the inner and outer wear bushings to be lowered by the drill pipe simultaneously into the wellhead, and wherein the subsea wellhead assembly further comprises:

outer locking means on the outer wear bushing for releasably locking the outer wear bushing to the casing hanger when the drill pipe lowers the inner and outer wear bushings into the wellhead, and for preventing axial movement of the outer wear bushing relative to the casing hanger during drilling; and retrieval locking means selectively actuable when it is desired to retrieve the outer wear bushing, for preventing the intermediate locking means from releasing the inner wear bushing from the outer wear bushing when the engaging shoulder contacts the inner wear bushing during upward movement of the drill pipe, causing both the inner and outer wear bushings to be simultaneously retrieved.

14. The subsea wellhead assembly according to claim 9 wherein:

the inner locking means comprises:

an inner shear member carried in mating recesses formed in the wear bushing sub and the inner wear bushing which shears upon the application of weight after the inner wear bushing lands in the wellhead housing; and the intermediate locking means comprises:

an intermediate shear member carried in mating recesses formed in the inner wear bushing and the outer wear bushing which shears upon the application of upward force by the engaging shoulder on the inner wear bushing.

15. In a subsea well assembly of the type having a wellhead housing and a casing hanger landed in the wellhead housing which supports a string of casing extending into the well, an improved wear bushing assembly for reducing wear damage occurring when a string of drill pipe is rotated in the well, comprising in combination:

an outer wear bushing removably supported on the casing hanger;

an inner wear bushing removably supported on the outer wear bushing, the inner wear bushing having a bore, the inner diameter of the bore of the inner wear bushing being smaller than an inner diameter of the casing near the casing hanger, providing a standoff to reduce contact of the drill pipe with the casing near the casing hanger to reduce wear on the casing;

a wear bushing sub connected into the string of drill pipe for extension through the bore of the inner wear bushing, the wear bushing sub being movable downward relative to the inner and outer wear bushings in unison with the drill pipe for further drilling;

an inner shear member located in mating recesses formed on the wear bushing sub and in the bore of the inner wear bushing, the inner shear member releasably locking the inner wear bushing to the wear bushing sub for allowing the drill pipe to lower the inner wear bushing into the wellhead housing as the drill pipe is being lowered into the well for further drilling, the inner shear member shearing to release the inner wear bushing from the wear bushing sub to allow the wear bushing sub to move downward with the drill pipe once the inner wear bushing has landed in the wellhead housing;

an engaging shoulder on the wear bushing sub configured to contact the inner wear bushing and lift the inner wear bushing when the wear bushing sub is pulled back upward for a trip; and an intermediate shear member located in mating recesses formed on the inner wear bushing and the outer wear bushing, the intermediate shear member releasably locking the inner wear bushing to the outer wear bushing for preventing axial movement of the inner wear bushing relative to the outer wear bushing during drilling, the intermediate shear member selectively shearing to release the inner wear bushing from the outer wear bushing when the engaging shoulder contacts the inner wear bushing during upward movement of the drill pipe.

16. The subsea wellhead assembly according to claim 15 further comprising:

an outer shear member located in mating recesses formed on the outer wear bushing and the casing hanger, the outer shear member releasably locking the outer wear bushing to the casing hanger for preventing axial movement of the outer wear bushing relative to the casing hanger during drilling, the outer shear member having a greater shear strength than the intermediate shear member, selectively causing the intermediate shear member to shear when the engaging shoulder contacts the inner wear bushing during upward movement of the drill pipe; and a retrieval shear member positioned in a retrieval recess formed on the inner wear bushing only when it is desired to retrieve the outer wear bushing, the outer wear bushing having a mating retrieval recess into which the retrieval shear member locates when the inner wear bushing is lowered into the outer wear bushing, the retrieval shear member and the intermediate shear member having a cumulative greater shear strength than the outer shear member, causing the outer shear member to shear to release the outer wear bushing from the casing hanger when the engaging shoulder contacts the inner wear bushing during upward movement of the drill pipe, causing both the inner and outer wear bushings to be simultaneously retrieved.

17. In a subsea well assembly of the type having a wellhead housing and a casing hanger landed in the wellhead housing which supports a string of casing extending into the well, an improved wear bushing assembly for reducing wear damage occurring when a string of drill pipe is rotated in the well, comprising in combination:

an outer wear bushing removably supported on the casing hanger;

an inner wear bushing removably supported on the outer wear bushing, the inner wear bushing having a bore, the inner diameter of the bore of the inner wear bushing being smaller than an inner diameter of the casing, providing a standoff to reduce contact of the drill pipe with the casing near the casing hanger to reduce wear on the casing;

a wear bushing sub connected into the string of drill pipe for extension through the bore of the inner wear bushing, the wear bushing sub being movable downward relative to the inner and outer wear bushings in unison with the drill pipe for further drilling;

an engaging shoulder on the wear bushing sub configured to contact the inner wear bushing and lift the inner wear bushing when the wear bushing sub is pulled back upward for a trip;

an intermediate shear member located in mating recesses formed on the inner wear bushing and the outer wear bushing, the intermediate shear member releasably locking the inner wear bushing to the outer wear bushing for preventing axial movement of the inner wear bushing relative to the outer wear bushing during drilling, the intermediate shear member selectively shearing to release the inner wear bushing from the outer wear bushing when the engaging shoulder contacts the inner wear bushing during upward movement of the drill pipe;

an outer shear member located in a recess formed on the outer wear bushing and which locates in a mating recess formed in the casing hanger when the outer wear bushing is lowered into the casing hanger, the outer shear member releasably locking the outer wear bushing to the casing hanger for preventing axial movement of the outer wear bushing relative to the casing hanger during drilling, the outer shear member having a greater shear strength than the intermediate shear member, selectively causing the intermediate shear member to shear when the engaging shoulder contacts the inner wear bushing during upward movement of the drill pipe for a trip; and a retrieval shear member positioned in a retrieval recess formed on the inner wear bushing only when it is desired to retrieve the outer wear bushing, the outer wear bushing having a mating retrieval recess into which the retrieval shear member locates when the inner wear bushing is lowered into the outer wear bushing, the retrieval shear member and the intermediate shear member having a cumulative greater shear strength than the outer shear member, causing the outer shear member to shear to release the outer wear bushing from the casing hanger when the engaging shoulder contacts the inner wear bushing during upward movement of the drill pipe, causing both the inner and outer wear bushings to be simultaneously retrieved.

18. The subsea wellhead assembly according to claim 17 further comprising:

an inner shear member located on mating recesses formed on the wear bushing sub and the bore of the inner wear bushing, the inner shear member releasably locking the inner wear bushing to the wear bushing sub for allowing the drill pipe to lower the inner wear bushing into the wellhead housing as the drill pipe is being lowered into the well for further drilling, the inner shear member shearing to release the inner wear bushing from the wear bushing sub to allow the wear bushing sub to move downward with the drill pipe once the inner wear bushing has landed in the wellhead housing.

19. A method for reducing wear damage occurring when a string of drill pipe is rotated in a well, the well having a wellhead housing, a casing hanger landed in the wellhead housing and supporting a string of casing extending into the well, comprising:

connecting a wear bushing sub into a string of drill pipe;

placing an inner wear bushing on the wear bushing sub and providing the inner wear bushing with a bore of a diameter smaller than an inner diameter of the casing;

landing an outer wear bushing on the casing hanger;

supporting the inner wear bushing in the outer wear bushing while the outer wear bushing is located on the casing hanger;

lowering the wear bushing sub and the drill pipe downward relative to the inner wear bushing and rotating the drill pipe, the inner diameter of the bore of the inner wear bushing providing a standoff to reduce contact of the drill pipe with the casing near the casing hanger to reduce wear on the casing; then picking up the drill pipe for a round trip, engaging the inner wear bushing with the wear bushing sub and retrieving the inner wear bushing with the wear bushing sub while leaving the outer wear bushing on the casing hanger; then lowering the inner wear bushing and the wear bushing sub with the drill pipe back onto the outer wear bushing; then again lowering the drill pipe and the wear bushing sub relative to the inner wear bushing to continue drilling.

20. The method according to claim 19 further comprising the step of releasably locking the inner wear bushing to the outer wear bushing to prevent movement of the inner wear bushing during drilling.

21. The method according to claim 19 further comprising the steps of:

releasably locking the inner wear bushing to the outer wear bushing to prevent movement of the inner wear bushing during drilling;

unlocking the inner wear bushing from the outer wear bushing when the drill pipe is pulled upward for a round trip; and relocking the inner wear bushing to the outer wear bushing when the drill pipe is lowered again for further drilling.

22. The method according to claim 19 further comprising the step of releasably locking the outer wear bushing to the casing hanger to prevent movement of the outer wear bushing during drilling; and unlocking the outer wear bushing from the casing hanger and retrieving the outer wear bushing simultaneously with the inner wear bushing when desired.

23. The method according to claim 19 further comprising the steps of:

releasably locking the outer wear bushing to the casing hanger to prevent movement of the outer wear bushing during drilling;

releasably locking the inner wear bushing to the outer wear bushing to prevent movement of the inner wear bushing during drilling;

unlocking the inner wear bushing from the outer wear bushing when the drill pipe is pulled upward for a round trip; and unlocking the outer wear bushing from the casing hanger and retrieving the outer wear bushing simultaneously with the inner wear bushing when desired.

24. The method according to claim 19 further comprising the step of releasably locking the inner wear bushing to the wear bushing sub when lowering the drill pipe, the wear bushing and the wear bushing sub into the wellhead, and unlocking the wear bushing sub from the inner wear bushing to lower the drill pipe further for drilling.

25. The method according to claim 19 further comprising the steps of:

releasably locking the inner wear bushing to the outer wear bushing prior to lowering the inner and outer wear bushings into the wellhead, then lowering the inner and outer wear bushings simultaneously into the wellhead; then releasably locking the outer wear bushing into the casing hanger; then lowering the wear bushing sub and drill pipe into the well for further drilling; then unlocking the inner wear bushing from the outer wear bushing when the drill pipe is pulled upward for a round trip; then relocking the inner wear bushing to the outer wear bushing when the drill pipe is lowered again for further drilling.

26. A method for reducing wear damage occurring when a string of drill pipe is rotated in a well, the well having a wellhead housing, a casing hanger landed in the wellhead housing and supporting a string of casing extending into the well, comprising:

connecting a wear bushing sub into a string of drill pipe;

releasably looking an inner wear bushing into an outer wear bushing and providing the inner wear bushing with a bore of diameter smaller than an inner diameter of the casing;

releasably locking the inner wear bushing to a wear bushing sub;

lowering the wear bushing sub and along with it the inner and outer wear bushings into the wellhead and releasably locking the outer wear bushing to the casing hanger;

unlocking the wear bushing sub from the inner wear bushing, lowering the wear bushing sub and the drill pipe downward relative to the inner wear bushing and rotating the drill pipe, the inner diameter of the bore of the inner wear bushing providing a standoff to reduce contact of the drill pipe with the casing near the casing hanger to reduce wear on the casing; then picking up the drill pipe for a round trip, engaging the inner wear bushing with the wear bushing sub, unlocking the inner wear bushing from the outer wear bushing and retrieving the inner wear bushing with the wear bushing sub while leaving the outer wear bushing on the casing hanger; then lowering the inner wear bushing and the wear bushing sub with the drill pipe back into the outer wear bushing and relocking the inner wear bushing to the outer wear bushing; then again lowering the drill pipe and the wear bushing sub relative to the inner wear bushing to continue drilling; then to retrieve the outer wear bushing, picking up the drill pipe, engaging the inner wear bushing with the wear bushing sub, unlocking the outer wear bushing from the casing hanger while keeping the inner wear bushing locked to the outer wear bushing and retrieving the inner and outer wear bushings with the wear bushing sub.

27. The method according to claim 26 wherein:

the step of locking the inner and outer wear bushings together comprises placing an intermediate shear member between mating recesses in the inner and outer wear bushings;

the step of unlocking the inner wear bushing from the outer wear bushings comprises shearing the intermediate shear member; and the step of relocking the inner wear bushing to the outer wear bushing comprises placing a replacement intermediate shear member on the recess of the inner wear bushing and locating the intermediate shear member into the recess on the outer wear bushing when lowering the inner wear bushing into the outer wear bushing.

28. The method according to claim 26 wherein:

the step of locking the inner and outer wear bushings together comprises placing an intermediate shear member between mating recesses in the inner and outer wear bushings;

the step of unlocking the inner wear bushing from the outer wear bushing comprises shearing the intermediate shear member;

the step of relocking the inner wear bushing to the outer wear bushing comprises placing a replacement intermediate shear member on the recess of the inner wear bushing and locating the intermediate shear member in the recess on the outer wear bushing while lowering the inner wear bushing into the outer wear bushing;

the step of locking the outer wear bushing to the casing hanger comprises placing an outer shear member in mating recesses on the outer wear bushing and on the casing hanger, and providing the outer shear member with more shear strength than the intermediate shear member; and the step of unlocking the outer wear bushing from the casing hanger comprises placing a retrieval shear member in mating retrieval recesses between the inner wear bushing and the outer wear bushing only when it is desired to retrieve the outer wear bushing, and providing the retrieval shear member with shear strength that when added to the shear strength of the intermediate shear member exceeds the shear strength of the outer shear member; then shearing the outer shear member when the wear bushing sub is pulled upward and engages the inner wear bushing.

* * * * *